United States Patent [19]

Garner et al.

[11] Patent Number: 4,555,352

[45] Date of Patent: Nov. 26, 1985

[54] LUBRICANT ADDITIVE

[75] Inventors: Alfred V. Garner; William W. Nalder, both of Raymond, Canada

[73] Assignee: Power-Aid Industries (1980) Ltd., Raymond, Canada

[21] Appl. No.: 630,683

[22] Filed: Jul. 13, 1984

Related U.S. Application Data

[63] Continuation-in-part of Ser. No. 483,288, Apr. 8, 1983, abandoned.

[51] Int. Cl.[4] ..... C10M 1/54

[52] U.S. Cl. ..... 252/35; 208/19; 252/36; 252/37

[58] Field of Search ..... 252/35, 36, 37; 208/19

[56] References Cited

U.S. PATENT DOCUMENTS

| | | | |
|---|---|---|---|
| 2,120,119 | 6/1938 | Steiner | 252/35 |
| 2,188,645 | 1/1940 | Buffington | 252/35 |
| 2,206,025 | 6/1940 | Buffington et al. | 252/35 |
| 2,214,634 | 9/1940 | Dombrow | 252/33 |
| 2,220,843 | 10/1940 | Johnson | 252/37 |
| 2,276,341 | 3/1942 | Prutton | 252/37 |
| 2,388,439 | 11/1945 | Raymond | 252/42.7 |
| 2,782,165 | 2/1957 | Peterson et al. | 252/41 |
| 2,863,847 | 12/1958 | Morway | 252/35 X |
| 3,175,972 | 3/1965 | Mitacek et al. | 252/35 X |
| 3,493,505 | 2/1970 | Ries, Jr. et al. | 208/19 X |
| 3,595,967 | 7/1971 | Riedel et al. | 208/19 |
| 3,873,455 | 3/1975 | Schieman | 208/19 X |
| 4,171,268 | 10/1979 | Collins | 252/35 X |

FOREIGN PATENT DOCUMENTS

| | | |
|---|---|---|
| 68155 | 7/1900 | Canada . |
| 369258 | 10/1937 | Canada . |
| 372200 | 3/1938 | Canada . |
| 385632 | 11/1939 | Canada . |
| 427435 | 5/1945 | Canada . |
| 463071 | 2/1950 | Canada . |
| 1036146 | 8/1978 | Canada . |

OTHER PUBLICATIONS

"Lubricant Additives", C. V. Smacheer et al., 1967, p. 1-11.

Vol. 14, *Kirk-Othmer Encyclopedia of Chemical Technology,* 3rd Ed., (1981), Wiley-Interscience, pp. 490-500, 524-526.

Vol. 3, *Kirk-Othmer Encyclopedia of Chemical Technology,* 3rd Ed., (1981), Wiley-Interscience, pp. 138-139.

Vol. 12, *Kirk-Othmer Encyclopedia of Chemical Technology,* 3rd Ed., (1981), Wiley-Interscience, pp. 712-733.

*Chemical Technology Review No.* 21, "Lubrican Additives and Grease Compositions", pp. 290-303.

*Primary Examiner*—Jacqueline V. Howard

*Attorney, Agent, or Firm*—Cushman, Darby & Cushman

[57] ABSTRACT

The present invention provides a lubricant additive composition which functions both as a friction reducing agent and as an extreme pressure additive, and also has the ability, when incorporated in a lubricant, to improve substantially the low temperature viscosity characteristics of the lubricant. The composition, in one form, comprises:

(1) about 35% by weight of 24% lead naphthenate solution in an organic solvent therefor;

(2) about 40% by weight of an oil having the following formulation:

97.4%-93.1% HVI 300 Neutral Paraffinic Base Oil
0.05%-0.15% anti-oxidant
0.0005%-0.005% anti-foaming agent
0.5%-1.5% anti-rust compound
1.0%-2.0% oiliness additive
1.0%-3.0% anti-wear compound
0.005%-0.25% pour point depressant; and (3) about 25% by weight of diesel oil (preferably desulfurized diesel oil).

In a second, heavy-duty form, the composition comprises: about 5% to about 45% by weight of a lead soap of an organic acid, said lead soap being in the form of a solution in a liquid organic solvent therefor, said solution containing from 10%-32% by weight lead; 20%-50% by weight of an oil having a viscosity in the range of from about 45 SUS at 100° F. to about 3000 SUS at 100° F.; and 5%-40% by weight of diesel oil (preferably desulfurized), or of a hydrocarbon oil having physical characteristics comparable to said diesel oil; said composition functioning both as a friction reducing agent and as an extreme pressure additive. Desirably, there may additionally be included in this composition: 0.10%-5.00% by weight of an oil soluble zirconium-containing soap selected from the group consisting of zirconium naphthenate, zirconium 2-ethylhexanoate, zirconium 3,5-dimethyl hexanoate, and zirconium neodecanoate, or mixtures thereof, and 0.10%-5.00% by weight of calcium in an oil soluble form, as calcium naphthenate or calcium 2-ethylhexanoate.

43 Claims, No Drawings

LUBRICANT ADDITIVE

This application is a continuation-in-part of application Ser. No. 483,288, filed Apr. 8, 1983, now abandoned.

The present invention relates generally to lubricant additive compositions, and more particularly relates to friction-reducing and extreme pressure lubricant additives.

In the production of lubricants numerous substances, for example, oleic acid, tricresyl phosphate, sulphur bearing compounds, tricresyl phosphate, sperm oil and sulfurized sperm oil, may be added to the base lubricant to contribute various properties or characteristics to the finished lubricant. Included among these are additives to improve extreme pressure and film strength properties of the lubricant; oxidation inhibitors; rust inhibitors; detergents; viscosity index improvers; pour point depressants; and oiliness, antiwear and/or antiweld agents.

The terms "extreme pressure", "film strength properties", and also "oiliness" and "lubricity" refer to the ability of lubricants to reduce friction and prevent wear and welding between working surfaces of bearings and gear teeth when, as a result of extreme pressure, low speed, high temperatures or reduced viscosity, the film which normally completely separates moving parts becomes thin enough to permit partial metal-to-metal contact. When moving machine parts are subjected to more severe conditions of load, speed and temperature, as for example, the high tooth pressures and high rubbing velocities often encountered in hypoid and spur-type gearing, base lubricating oils themselves do not have the necessary qualities to provide adequate lubrication; metal-to-metal contact would occur which results in scoring, galling and local seizure of the gear teeth; therefore it is necessary to employ lubricants which contain extreme pressure additives. Conventionally employed additives of this type, and also additives for imparting antiwear properties to the lubricants, are generally phosphorus, chlorine and/or sulfur compounds which react with metal surfaces to reduce friction and prevent welding.

Numerous lubricant compositions which contain antiwear agents and/or extreme pressure additives are known, and have been described in various patents and other literature. For instance, Johnson describes in U.S. Pat. No. 2,220,843 an extreme pressure lubricant which comprises a major proportion of a refined lubricating oil and as additives, a sulfurized ester of an unsaturated acid and a heavy metal naphthenate.

In U.S. Pat. No. 2,276,341 (Prutton) an extreme pressure lubricant is described, which comprises a hydrocarbon lubricating oil, from about 1% to about 5% of a metal naphthenate or naphthenic acid ester, and any one of a wide variety of halogenated organic compounds.

Kaufman et al disclose in Canadian Pat. No. 427,435, granted May 8, 1945, lubricants for use under high pressure conditions; these are prepared by first preparing a sulfurized lubricating oil by heating the oil and sulfur at temperatures of 320°–375° F., and then incorporating a small amount of lead naphthenate in the sulfurized oil.

An objective of the present invention is to provide a lubricant additive composition which functions both as a friction reducing agent and as an extreme pressure additive.

Another objective of the invention is to provide a lubricant additive which, when incorporated in a lubricant, substantially improves the low temperature viscosity characteristics of the lubricant.

A further objective of the invention is to provide a friction-reducing and extreme-pressure lubricant additive of a relatively high degree of uniformity, but which is relatively easy to manufacture, requiring a minimum of quality control.

A yet further objective of this invention is to provide an effective friction-reducing and extreme-pressure lubricant additive which does not require the presence of corrosive phosphorus-, nitrogen- or halogen-containing compounds and/or sulfurized compounds to impart the desired degree of extreme-pressure properties thereto.

The present invention provides an improved lubricant additive composition which imparts friction reducing, lubricity and extreme pressure properties to lubricants, and which does not require the use of complex phosphorus-, chlorine-, nitrogen- and/or sulfur-containing organic compounds such as characterize most known lubricant additives of this type.

In one aspect, the present invention resides in a lubricant additive composition which comprises:

(1) about 35% by weight of a 24% (by weight) solution of lead naphthenate in an organic solvent therefor;

(2) about 40% by weight of an oil of the following formulation:

97.4%–93.1% HVI 300 Neutral Paraffinic Base Oil
0.05%–0.15% anti-oxidant
0.0005%–0.005% anti-foaming agent
0.5%–1.5% anti-rust compound
1.0%–2.0% oiliness additive
1.0%–3.0% anti-wear compound
0.005%–0.25% pour point depressant; and (3) about 25% by weight of diesel oil. Preferably the diesel oil used as component (3) of this composition is desulfurized. This composition may include 1% by weight (in the lead naphthenate solution) of a non-aromatic odorant material.

In another aspect, this invention provides a "heavy-duty" lubricant additive composition which, in its essentials, comprises: (1) a lead soap of an organic acid, preferably lead naphthenate; (2) an oil of a minimum viscosity of 45 SUS at 100° F.; and (3) diesel oil (preferably desulfurized diesel oil) or an equivalent thereof. There may also be included the following additional ingredients; (4) a zirconium soap; and (5) a calcium soap. More particularly, this aspect of the invention resides in a heavy duty lubricant additive composition comprising:

(1) about 5% to about 45% by weight of a lead soap of an organic acid, said lead soap being in the form of a solution in a liquid organic solvent therefor, said solution containing from about 10% to about 32% by weight lead;

(2) 20%–50% by weight of an oil having a viscosity in the range of from about 45 SUS at 100° F. to about 3000 SUS at 100° F.; and (3) 5%–40% by weight of diesel oil, or of a hydrocarbon oil having physical characteristics comparable to said diesel oil; said composition functioning both as a friction reducing agent and as an extreme pressure (EP) additive. This heavy duty formulation may also (desirably) include the following ingredients:

(4) 0.10%–5.00% by weight of an oil-soluble zirconium-containing soap selected from the group consisting of zirconium naphthenate, zirconium 2-ethylehexanoate, zirconium, 3,5-dimethyl hexanoate, and zirconium neodecanoate, or mixtures thereof; and (5) 0.10%-5.00% by weight of calcium in an oil-soluble form, as calcium naphthenate or calcium 2-ethylhexanoate. The composition may also contain from about 0.1% to about 3% by weight of a non-aromatic odorant material for assisting in product identification.

Desirably also this "heavy duty" composition contains in addition an antioxidant in an amount of from about 0.01% to about 1.00% by weight of said composition.

An odorant is also desirably included as a means of easy product identification. This may be incorporated in the lead soap solution in an amount ranging from 0.1% to about 3.0% by weight based on said lead soap solution. The odorant may be any of a wide variety of odorant substances, with the proviso that it is non-polluting and non-toxic; thus nitrobenzene is not suitable as an odorant for purposes of the present invention, and is excluded.

The lead soap employed may be of the basic neutral or acid positive type; preferably it is lead naphthenate, the lead content of which may vary from about 10% to about 32% by weight. However, basic, neutral or acid positive lead compounds produced from other organic acid radicals than naphthenic acid may be utilized as partial or total substitutes for lead naphthenate, in the formulation of the present invention. The organic acids may be, if desired, or animal or vegetable origin as well as hydrocarbon-derived.

The oil component is preferably a hydrocarbon oil, which may range in viscosity from about 45 SUS at 100° F. to about 1200 SUS at 100° F.; and may be predominantly paraffinic, predominantly naphthenic, or a mixture of paraffinic and naphthenic. Oils of vegetable of animal origin may, however, be usefully employed in the formulations of the present invention, as may synthetic lubricants such as organic diesters, polyglycols (polyethylene oxide or polypropylene oxide), silicone oils, phosphate esters (eg. tricresyl phosphate), and polyphenyl ethers; and polyolefins, eg. polybutene and low molecular weight polyisobutylene.

The upper limit of viscosity for the oil used as component (2) of our additive compositions is that at which the oil can no longer readily penetrate into moving machinery parts under service conditions of temperature and pressure. Thus, there may be used, as component (2) of our composition, any oil of the above classes which has a viscosity ranging from a minimum of about 45 SUS at 100° F. up to any vicosity level that would not seriously inhibit the flow of additive to the moving parts, under operating conditions. As a practical matter, the upper limit of viscosity of the oil which may be used is believed to be about 3000 SUS at 100° F.

A suitable oil for use as the oil component of the compositions of the present invention is one which has the following formulation:

97.4%-93.1% HVI 300 Neutral Paraffinic Base Oil
0.05%-0.15% anti-oxidant
0.0005%-0.005% anti-foaming agent
0.5%-1.5% anti-rust compound
1.0%-2.0% oiliness additive
1.0%-3.0% anti-wear compound
0.005%-0.25% pour point depressant The various additives in this formulation, viz, the antioxidant, anti-foaming agent, anti-rust compound, oiliness additive, anit-wear compound, and pour point depressant, are chosen from those which are conventionally known and used for such purpose(s).

Other suitable oils for use as the oil component of the compositions of this invention are those sold by Shell Oil Company under the trademark "Tellus", which oils are, among other things, used for hydraulic purposes. Included among oils which are suitable for purposes of the present invention are blends of HVI 100 Neutral Oil and HVI 250 Neutral Oils. Such blends normally contain various additives to lower pour point, improve oxidation resistance, etc. Examples of oils which are suitable for use in the present invention are set forth in Tables I and II.

Also included herein for reference purposes (see Table III) are the characteristics of a number of Shell base stocks.

Other oils comparable in physical properties to the oils referred to above may be used in the compositions of this invention, such as, for example, the "Harmony" TM oils produced by Gulf Oil Company.

HVI Brightstock oils may also be used as the oil component of the compositions of this invention. Such Brightstock oils as are commonly processed and used on the North American continent have a viscosity @ 210° F. in the range of 120-170 SUS and more particularly in the range of 150-165 SUS. Such oils will have viscosities @ 100° F. in the range of 2000-3000 SUS. The enclosed Tables IV and V show representative examples of HVI Brightstock oils.

The lubricant additive compositions of this invention also include from about 5% to about 40% by weight of diesel oil, (which preferably is, but does not necessarily have to be, desulfurized), or of a hydrocarbon oil of comparable physical characteristics having other applications than for diesel purposes. Such oils may optionally contain additives to control icing, rust and corrosion buildup, etc., as is well known to those skilled in the art. Suitable desulfurized diesel oils are those sold by Gulf Canada Limited under the trademarks "Gulf Diesel Fuel 20X", "Gulf Diesel Fuel 25", and "Gulf Diesel Fuel 40". The characteristics of these oils are set forth in Tables VI, VII and VIII.

The compositions of this invention may also include from about 0.10% to about 5.00% by weight of an oil-soluble zirconium-containing soap which is selected from the following: zirconium naphthenate, zirconium 2-ethylhexanoate, zirconium 3,5-dimethyl hexanoate, or zirconium neo-decanoate, or mixtures thereof.

Finally, there may be included in the composition of this invention from about 0.10% to about 5.00% by weight of calcium on an oil-soluble form as calcium napthenate or calcium 2-ethylhexanoate.

Following is a description of a suitable method by which the compositions of the present invention are manufactured:

The calculated volumes of lead soap (e.g. 24% lead naphthenate) and HVI 300 Neutral Paraffinic Oil (with any additives) are blended together mechanically at room temperature until complete dispersion of the lead soap is accomplished (as measured by lead metal concentration). To achieve complete dispersion stirring for 30 minutes with "paddle" stirrers operating at 30-60 rpm or for 15 minutes with "turbine" or similar stirrers operating at 500-1500 rpm is required.

Prior to manufacture, the diesel oil component of the formulation is subjected to treatment at room temperature with a commercial grade of sodium hypochlorite (5% solution) for 15 minutes, stirring mechanically throughout with stirrers of the above noted types. The treated diesel oil is allowed to separate from the aqueous sodium hypochlorite layer and is then decanted. Such quantities of hypochlorite as remain in the treated diesel oil are not injurious to the end product, providing no "free" aqueous liquid is present in the treated oil.

The calculated volume of treated diesel oil is added to the lead soap/HVI 300 Neutral Paraffin Oil blend, the whole being blended for a further 30 minutes or 15 minutes time period according to the type of stirrers used.

The addition of minor components (if any) is now made, stirring in each addition separately and employing the above noted time periods depending upon the type of stirrers used.

The final product is checked for:

(a) lead metal content
(b) Specific Gravity 15.5/15.5 C
(c) Colour
(d) Clarity and corrections made with whichever component (s) is required to produce the required lead metal content, all corrections being mixed in according to the time scales and stirrer types identified above.

N.B. The percentage of Lead metal present in the composition of the present invention may be measured by any of the following methods:

1. EDTA titration.
2. Volumetric precipitation of lead as lead chloride.
3. Atomic absorption Spectrograph.
4. Gravimetric determination of lead as (a) lead chromate or (b) lead sulphate.

It is not uncommon in the preparation of extreme pressure oils and greases for the manufacturer of such products to sulphurize one or more of the oils used in the preparation thereof. This is not only time-consuming but can also be a variable operation, and requires that extreme environmental care be taken. In the lubricant additive of the present invention it is not necessary that a sulfurized oil be used as an ingredient; and the additive of this invention is a simply and easily produced composition of high uniformity requiring no involved processing techniques and a minimum of quality control.

Desirably the compositions of the present invention also contain a small amount of an oil-soluble dye or comparable colorant material, to assist in product identification.

In preferred compositions according to this invention there is included between about 10% and about 15% by weight of a liquid organic solvent for the lead soap. Such solvent may be for example mineral spirits ("Shellsol"*, "Varsol 3139"**, etc.) which imparts a high degree of penetration of the composition. Effective penetration is very important, if the composition is to perform satisfactorily. While the lead compound present in the formulation is the active ingredient, it is only effective as a friction reducer/lubricating agent/extreme pressure additive if it can penetrate to the working parts in which it is to function. The required penetration properties are supplied by the organic solvent (eg. mineral spirits) present in the lead soap solution and also, to a lesser extent, by the desulfurized diesel oil in the formulation. This aspect of the formulation is believed to be critical.

*Trademark
**Trademark

In a preferred aspect of the invention the composition contains 8.4% by weight of lead in the form of basic lead naphthenate.

The oil present in the formulation (component (2)) acts as a general lubricant, and also as a dispersant for the lead soap.

The addition of an oil soluble zirconium soap in a basic, acid positive or neutral form it is believed, serves to synergize the effect of the lead soap present in the formulation while the calcium in an oil-soluble form can act as a dispersant for the lead soap and as a synergist; and also has the ability to improve the alkali resistance of the formulation.

One preferred composition of the present invention comprises:

about 35% by weight 24% lead naphthenate solution (in an organic solvent therefor) (which may contain 1% by weight of an odorant material);
about 40% by weight of an oil of the following formulation:
97.4%–93.1% HVI 300 Neutral Paraffinic Base Oil
0.05%–0.15% anti-oxidant
0.0005%–0.005% anti-foaming agent
0.5%–1.5% anti-rust compound
1.0%–2.0% oiliness additive
1.0%–3.0% anti-wear compound
0.005%–0.25% pour point depressant; and
about 25% by weight of diesel oil.

A unique characteristic of the lubricant additive composition of the present invention in that it functions both as a friction reducing agent and as an extreme pressure additive. Of the two characteristics the friction reducing properties of the composition will perhaps be more evident to the user. It is very effective in lubricating the moving parts of gear boxes, automobile engines, transmissions, general bearings, journals, etc.

It has been found, from extensive experience of using the aforedescribed additive in a variety of applications that the friction-reducing, extreme-pressure agent composition of this invention may be used in lubricants (e.g. lubricating oils) to enhance the properties of the latter, in amounts ranging from about 1.0% to about 7.5% by volume per volume of the lubricant. Additives levels within the above range are those which have been found to be both useful and practical.

For a primary or initial treatment of a lubricant, it has been found desirable to incorporate our additive composition in the lubricant at around the upper level of this range, i.e. at about 7.5% by volume based on the volume of lubricant. As a regular or on-going treatment the addition to the lubricant of about 2.5% by volume of the additive based on the volume of lubricant, gives very satisfactory results. The additives of this invention could, of course, be incorporated in a lubricant in amounts greater than 7.5 parts by volume per 100 parts by volume of lubricant, but this would serve no useful purpose; it would be wasteful and confer no benefits beyond what are already provided by the additive at the lower levels stated above. The incorporation in a lubricant of about 2.5 parts by volume per 100 parts by volume lubricant of the additive composition of this invention has been found to give quite acceptable performance results; however it has been found that the addition to a lubricant of as little as about 1.0 parts by volume per 100 parts by volume of the lubricant of our novel composition, will give an improvement in lubricant performance as measured buy improved lubricity and lower bearing temperatures.

The effectiveness of the compositions of this invention as a friction reducing agent and extreme pressure additive has been demonstrated by actual testing, for which purpose a test piece was especially built. Also demonstrated was the effectiveness of the additive of the invention when lubricating oil containing the additive was removed from the bearing. The traces of oil-/additive remaining on the bearing gave sufficient lubricity to allow the shaft to be rotated at high speed for an extended period of time. The same test has been performed in selected test engines, i.e. where the treated oil is drained from the crankcase, under which circumstances the engine continues to perform for an extended period of time without seizure occurring.

A further important feature of the composition of the present invention is that, when said composition is incorporated in a lubricant, it substantially improves the low temperature viscosity characteristics of the lubricant. Attached thereto as Table IX is viscosity information generated by the Ontario Research Foundation which demonstrates in a very clear manner that the incorporation of four friction-reducing, extreme pressure additive composition in multi-grade and straight-grade engine oils beneficially affects the low temperature viscosity of such oils, which in turn would have a profound effect on the "cold start-up" of car and truck engines and machinery operating in low-temperature external locations. Straight code and multi-grade motor oils containing our lubricant additive will have lubricity characteristics at low temperatures which are superior to those of many of the multi-grade engine oils now on the market.

While the present invention has been described herein in terms of certain preferred embodiments, it is to be understood that this invention is not to be limited thereto, as certain modifications and variations in the ingredients and proportions thereof may be made, as will be apparent to those skilled in the art. It is desired, therefore, that the invention be limited only by the claims which follow.

TABLE I

| Product | Shell Rock Drill Oil 21 EP | Shell Tonna R Oil 27 | Shell Tonna R Oil 41 | Shell Tonna R Oil 72 | Shell Tellus Oil 11 | Shell Tellus Oil 15 | Shell Tellus Oil 23 | Shell Tellus Oil 27 |
|---|---|---|---|---|---|---|---|---|
| Gravity API | 22.5 | 23.2 | 22.8 | 22.2 | 34.9 | 30.5 | 29.0 | 28.5 |
| Colour | — | — | — | — | 0.5 | 0.5 | 0.5 | L 1.0 |
| Pour Point °F. | −55 | −60 | −15 | 0 | −35 | −45 | −20 | −15 |
| Viscosity | | | | | | | | |
| SSU @ 100° F. | 100 | 168 | 534 | 1327 | 45 to 50 | 60 to 70 | 115–150 | 150–180 |
| SSU @ 210° F. | 39 | 49 | 59 | 84 | 32.5–33.5 | 34.5–37.0 | 39.5–42.5 | 40.0–46.0 |
| VI | 60 | 148 | 65 | 53 | — | — | — | — |
| Flash Point °F. | 320 | 300 | 400 | 480 | 200 | 325 | 380 | 405 |
| Steam Emulsion No. | 1200+ | 1200+ | 1200+ | 1200+ | — | — | — | — |
| Timken OK Load lbs. | 20 | 30 | 35 | 40 | — | — | — | — |
| Rams. Bottom Carbon Res. Wt. % | .11 | .20 | .16 | .25 | — | — | — | — |
| Ambient Temp. Range | −50° F.-0° F. | −20° F.-+60° F. | +40° F.-+90° F. | Above +90° F. | — | — | — | — |
| Specific Gravity °F. | — | — | — | — | 0.850 | 0.876 | 0.881 | 0.884 |
| Neutralization Value (TAN) | — | — | — | — | 0.5 | 0.5 | 0.5 | 0.5 |
| Cu Strip Corrosion @ 212° F. | — | — | — | — | 1a | 1a | 1a | 1a |
| ASTM Rust Test 24 hrs. | | | | | | | | |
| Distilled Water and | — | — | — | — | Pass | Pass | Pass | Pass |
| Synthetic Sea Water | — | — | — | — | Pass | Pass | Pass | Pass |
| ASTM Foam Test Sequence 1, 2, and 3 | — | — | — | — | Pass | Pass | Pass | Pass |
| | SHELL TONNA R OILS - For lubrication of rock drills, jack hammers, sinkers, and other air operated percussion tools. Shell Rock Drill Oil 21 EP is used under the most severe winter conditions. Extreme pressure properties, rust protection, adhesiveness. | | | | SHELL TELLUS OILS - Low pour point, oxidation resistance, low deterioration at high temps. rust and corrosion protection, good demulsibility. Recommended for use in machine tools, mobile equipment, hydraulic and circulating systems, with wide variations of temperature. Also recommended for lubrication of spindles, ball and roller bearings and gears. Anti-wear hydraulic oil. | | | |

TABLE II

| Product | Shell Tellus Oil 29 | Shell Tellus Oil 33 | Shell Tellus Oil 41 | Shell Tellus Oil 69 | Shell Tellus Oil 72 | Shell Tellus Oil 75 | Shell Garia Oil A | Shell Garia Oil D |
|---|---|---|---|---|---|---|---|---|
| Gravity API | 28.2 | 27.5 | 27.1 | 27.4 | 27.0 | 26.1 | 12.2 | 20.6 |
| Colour | L 1.5 | L 1.5 | L 2.0 | L 4.0 | 4.0 | L 5.0 | 5.5 | 3.5 |
| Specific gravity @ 60° F. | 0.886 | 0.890 | 0.892 | 0.890 | 0.893 | 0.898 | 0.985 | 0.930 |
| Pour Point °F. | −15 | −15 | −10 | 0 | +10 | +10 | −40 | −10 |
| Flash Point °F. | 405 | 430 | 460 | 460 | 485 | 510 | 140 | 360 |
| Viscosity | | | | | | | | |
| SSU @ 100° F. | 225–245 | 300–325 | 500–550 | 645–720 | — | — | 100 | 150 |
| SSU @ 210° F. | 44–52 | 47–56 | 57.5–68.0 | 70–75 | 80–90 | 110–120 | 39 | 41 |
| Neutralization Value (TAN) | 0.5 | 0.5 | 0.5 | 0.5 | 0.5 | 0.5 | — | — |

TABLE II-continued

| Product | Shell Tellus Oil 29 | Shell Tellus Oil 33 | Shell Tellus Oil 41 | Shell Tellus Oil 69 | Shell Tellus Oil 72 | Shell Tellus Oil 75 | Shell Garia Oil A | Shell Garia Oil D |
|---|---|---|---|---|---|---|---|---|
| Cu Corrosion @ 212° F. | 1a | 1a | 1a | 1a | 1a | 1a | — Pos. | — Pos. |
| ASTM Rust Test @ 24 hrs. | | | | | | | | |
| Distilled Water and | Pass | Pass | Pass | Pass | Pass | Pass | — | — |
| Synthetic Sea Water | Pass | Pass | Pass | Pass | Pass | Pass | — | — |
| Foam Test, Sequence 1, 2, and 3 | Pass | Pass | Pass | Pass | Pass | Pass | — | — |
| Saponification No. | — | — | — | — | — | — | 3.7 | 6.2 |
| Total Sulphur, % wt. | — | — | — | — | — | — | 2.66 | 1.95 |
| Total Chlorine % wt. | — | — | — | — | — | — | 20.5 | 0.75 |
| Appearance | — | — | — | — | — | — | Clear | clear |
| | SHELL TELLUS OILS - Low pour point, oxidation resistance, low deterioration at high temperature, rust and corrosion protected, good demulsibility. Recommend for use in machine tools, mobile equipment, hydraulic and circulating systems, with wide variations of temperature. Also recommended for lubrication of spindles, ball and roller bearings and gears. An anti-wear hydraulic oil. | | | | | | SHELL GARIA OILS - Form transparent oil films, light colour. | |

TABLE III

| | SHELL CANADA LIMITED HVI BASE STOCKS | | | |
|---|---|---|---|---|
| | Code (410-001) HVI 100 Neutral Typical Properties | Code (410-002) HVI 250 Neutral Typical Properties | Code (410-003) HVI 580 Neutral Typical Properties | Code 410- HVI Bright Stock Typical Properties |
| Density at 15° C., kg/L | 0.8571 | 0.8741 | 0.8795 | 0.892 |
| Colour, ASTM D 1500 | L 0.5 | L 0.5 | L 1.5 | 3.0 |
| Pour Point, °C. | −18 | −15 | −12 | −18 |
| Flash, COC, °C. | 196 min. | 226 min. | 260 min. | 327 |
| Viscosity at 40° C., $mm^2/s$ | 19.12 | 51.2 | 110.7 | 2819 SSU @ 100° F. |
| Viscosity at 100° C., $mm^2/s$ | 3.92 | 7.08 | 11.06 | 161 SSU @ 210° F. |
| Viscosity Index | 95 | 94 | 95 | |
| Carbon Residue, % by mass | 0.07 | 0.07 | 0.07 | 0.05 |
| Neutralization Value, mg KOW/g, TAN-C | 0.01 | 0.01 | 0.01 | |
| Sulphur, % by mass | 0.36 | 0.54 | 0.58 | |
| Corrosion at 100° C. Cu. strip 3 h | No. 1 | No. 1 | No. 1 | |
| Active Sulphur at 204° C. | Nil | Nil | Nil | |
| Appearance | Clear & Bright | Clear & Bright | Clear & Bright | Clear & Bright |
| Aniline Point, °C. | 99.5 | 105 | 115 | 124 |
| Demulsibility D 1401 at 82° C., 20 min. mL lacy stuff - with distilled water | | | 40-40-0 | |
| Demulsibility D 1401 at 54° C., 10 min. mL lacy stuff - with distilled water | 40-40-0 | 40-40-0 | | |
| Herschel demulsibility test at 82° C. mL oil separated per hour | | | | 180 |

TABLE IV

| SHELLFLEX* 810 BRIGHTSTOCK OIL TYPICAL VALUES | |
|---|---|
| Specific Gravity/60° F. | 0.892 |
| Viscosity SSU @ 100° F. | 2819 |
| Viscosity SSU @ 210° F. | 161 |
| Aniline Point °F. | 260 |
| Pour Point °F. | 0 |
| Viscosity Gravity Constant | 0.801 |
| Colour ASTM D1500 | 3.0 |
| Flash Point °F. (C.O.C.) | 620 |
| Average Molecular Weight | 750 |
| C.C.R. % | 0.05 |
| I.B.P. °F. | 812 |
| 50% °F. | 1028 |
| Molecular Analysis (Clay Gel) | |
| Polar Compounds | 2.3 |
| Aromatics | 20.5 |
| Saturates | 77.2 |

*Registered Trade Mark - Shell Canada Limited

TABLE V

| GULF "PARAFLEX HT 460"* BRIGHTSTOCK OIL TYPICAL VALUES | |
|---|---|
| Density, kg/L @ 15° C. | 0.879 |
| Gravity, API | 29.4 |
| Gravity, Specific @ 60° F. | 0.879 |
| Colour ASTM | <0.5 |
| Flash °C. COC | 302 |
| Viscosity: | |
| cSt @ 40° C. | 440 |
| cSt @ 100° C. | 32.33 |
| S.S.U. @ 100° F. (37.8° C.) | 2343 |
| S.S.U. @ 210° F. (98.9° C.) | 157.6 |
| Pour Point, °C. | −6 |
| Aniline Point, °C. | 138 |
| Clay Gel Analysis, wt. % | |
| Polar Aromatics | 0.5 |
| Aromatics | 1.2 |
| Total Aromatics | 1.7 |
| Saturates | 98.3 |
| Carbon Type Analysis, wt. % | |

TABLE V-continued

| GULF "PARAFLEX HT 460"* BRIGHTSTOCK OIL TYPICAL VALUES | |
|---|---|
| Ca | 0 |
| Cn | 30 |
| Cp | 70 |
| Average Molecular Weight | 660 |
| Carbon Number Range | 42–56 |
| Average Carbon Number | 48 |
| Distillation | ASTM D 2887 |
| IBP | 619° F. |
| 5% | 860° F. |
| 10% | 948° F. |
| 30% | 1036° F. |
| 50% | 1075-Carbon No. 50 |
| 70% | 1112° F. |
| 90% | 1179° F. |

*Trademark

TABLE VI

| GULF CANADA LIMITED PRODUCT TYPICAL ANALYSIS GULF DIESEL FUEL 20X | |
|---|---|
| A.P.I. Gravity | 32–36 |
| Colour | 0.5 |
| Sulphur, % | 0.5 |
| Cloud Point, °F. | +20 |
| Pour Point, °F. | +10 |
| Flash Point, °F. | 125 Minimum |
| Cetane Index | 40+ |
| Viscosity: Kinematic at 100° F. (centistokes) | 3.1 |
| SUS at 100° F. | 36 |
| Distillation: | |
| I.B.P. °F. | 362 |
| 10% | 420 |
| 50% | 528 |
| 90% | 618 |
| F.B.P. °F. | 654 |

| GULF CANADA LIMITED SUMMER GRADE GULF DIESEL FUEL 20x Typical Chemical Analysis | |
|---|---|
| Calcium | 0.030 ppm |
| Nickel | 0.08 ppm |
| Sodium | 0.57 ppm |
| Lead | 0.013 ppm |
| Potassium | 0.10 ppm |
| Vanadium | 0.28 ppm |

TABLE VII

| GULF CANADA LIMITED PRODUCT TYPICAL ANALYSIS GULF DIESEL FUEL 25 | |
|---|---|
| A.P.I. Gravity | 39.4 |
| Colour | 0.5 |
| Sulphur, % | 0.5 |
| Cloud Point, °F. | −10 |
| Pour Point, °F. | −25 |
| Flash Point, °F. | 145 |
| Cetane Index | 46 |
| Viscosity - Kinematic at 100° F. (centistokes) | 2.0 |
| SUS at 100° F. | 33 |
| Distillation °F.: | |
| I.B.P. | 344 |
| 10% | 383 |
| 50% | 458 |
| 90% | 565 |
| F.B.P. | 632 |
| Recovery | 99 |

TABLE VIII

| GULF CANADA LIMITED PRODUCT TYPICAL ANALYSIS GULF DIESEL FUEL 40 | |
|---|---|
| A.P.I. Gravity | 40.4 |
| Specific Gravity | 0.823 |
| Colour | 10.5 |
| Sulphur, % | 0.5 |
| Cloud Point °F. | −35 |
| Pour Point, °F. | −40 |
| Flash Point, °F. | 150 |
| Cetane Number | 48 |
| Viscosity: Kinematic at 100° F., (centistokes) | 1.9 |
| SUS at 100° F. | 32.0 |
| Distillation °F.: | |
| I.B.P. | 349 |
| 10% | 385 |
| 50% | 440 |
| 90% | 514 |
| F.B.P. | 560 |
| Recovery | 99 |

TABLE IX

Viscosity of "Power Aid"* and SAE Oil/"Power Aid"*

| Sample | Speed (rpm) | VISCOSITY −46° C. | 22° C. | 100° C. |
|---|---|---|---|---|
| SAE 10W30 | 10 | 62,400 | 112 | |
| | 20 | 66,200 | 120 | 30 |
| | 50 | 63,280 | 123 | 25 |
| | 100 | | 148 | 33 |
| SAE 20W | 5 | 380,000 | 128 | |
| | 10 | 296,000 | 136 | |
| | 20 | | 132 | 20 |
| | 50 | | 139 | 24 |
| | 100 | | 160 | 25 |
| "Power Aid" | 20 | 784 | 24 | 10 |
| | 50 | 804 | 32 | 13 |
| | 100 | 553 | 42 | 16 |
| SAE 10W30/ "Power Aid" | 10 | 1,900 | 120 | |
| | 20 | 2,170 | 118 | 14 |
| | 50 | 2,400 | 126 | 28 |
| | 100 | | 148 | 34 |
| SAE 20W "Power Aid" | 10 | 5,000 | 120 | 12 |
| | 20 | 5,280 | 122 | 12 |
| | 50 | | 132 | 25 |
| | 100 | | 154 | 30 |

Note:
SAE/"Power Aid:" 1 fl. oz of "Power Aid" to 1 quart SAE Oil.
Viscosity RVT Model, Spindle #2.
*"Power Aid" is a tradename for the friction-reducing, extreme pressure additive composition of the present invention.

We claim as our invention:

1. A heavy duty lubricant additive composition comprising:
   (1) from about 5% to about 45% by weight of a lead soap of an organic acid, said lead soap being in the form of a solution in a liquid organic solvent therefor, said solution containing from 10%–32% by weight lead;
   (2) 20%–50% by weight of an oil having a viscosity in the range of from about 45 SUS at 100° F. to about 3000 SUS at 100° F.; and
   (3) 5%–40% by weight of diesel oil, or of a hydrocarbon oil having physical characteristics comparable to said diesel oil; said composition functioning both as a friction-reducing agent and as an extreme pressure (EP) additive.

2. A lubricant additive composition according to claim 1 which further comprises:
   (4) 0.10%–5.0% by weight of an oil-soluble zirconium-containing soap selected from the group consisting or zirconium naphthenate, zirconium 2-ethylhexanoate, zirconium 3.5-dimethyl hexanoate, and zirconium neodecanoate, or mixtures thereof; and (5) 0.10%–5.0% by weight of calcium in an oil-soluble form, as calcium naphthenate or calcium 2-ethylhexaneoate.

3. A lubricant additive composition according to claim 1 wherein component (3) is a desulfurized diesel oil.

4. A lubricant additive composition according to claim 1 which further comprises from 0.01%–1.00% by weight of an anti-oxidant.

5. A composition according to claim 1 wherein component (3) is a desulfurized diesel oil additionally containing conventional de-icing additives and/or additives for controlling corrosion.

6. A composition according to claim 1 wherein component (2) is a petroleum-derived hydrocarbon oil.

7. A composition according to claim 1 wherein component (2) is a synthetic oil selected from the group consisting of polybutene and low molecular weight polyisobutylene.

8. A composition according to claim 1 wherein component (2) is a silicone oil.

9. A composition according to claim 1 wherein component (2) is a phosphate ester synthetic lubricant.

10. A composition according to claim 1 wherein component (2) is an organic diester synthetic lubricant.

11. A composition according to claim 1 wherein component (2) is a polyglycol synthetic lubricant.

12. A composition according to claim 1 wherein component (2) is an oil of animal or vegetable origin.

13. A composition according to claim 1 wherein the lead soap is lead naphthenate.

14. A composition according to claim 2 wherein the lead soap is lead naphthenate.

15. A composition according to claim 1, the solvent for said lead soap is an aliphatic hydrocarbon solvent.

16. A composition according to claim 1, further comprising from 10% to 15% by weight of mineral spirits.

17. A composition according to claim 1 wherein component (2) is a predominantly paraffinic petroleum-derived hydrocarbon oil.

18. A composition according to claim 2 wherein the zirconium-containing soap is zirconium naphthenate.

19. A composition according to claim 2 wherein component (5) is calcium naphthenate.

20. A composition according to claim 1, wherein component (3) is a diesel oil having the following characteristics:

| | |
|---|---|
| A.P.I. Gravity | 40.4 |
| Specific Gravity | 0.823 |
| Colour | 10.5 |
| Sulphur, % | 0.5 |
| Cloud Point °F. | −35 |
| Pour Point, °F. | −40 |
| Flash Point, °F. | 150 |
| Cetane Number | 48 |
| Viscosity: Kinematic at 100° F. (centistokes) | 1.9 |
| SUS at 100° F. | 32.0 |
| Distillation °F.: | |
| I.B.P. | 349 |
| 10% | 385 |
| 50% | 440 |
| 90% | 514 |
| F.B.P. | 560 |
| Recovery | 99 |

21. A composition according to claim 1, wherein component (3) is a diesel oil having the following characteristics:

| | |
|---|---|
| A.P.I. Gravity | 39.4 |
| Colour | 0.5 |
| Sulphur, % | 0.5 |
| Cloud Point, °F. | −10 |
| Pour Point, °F. | −25 |
| Flash Point, °F. | 145 |
| Cetane Index | 46 |
| Viscosity - Kinematic at 100° F. (centistokes) | 2.0 |
| SUS at 100° F. | 33 |
| Distillation °F.: | |
| I.B.P. | 344 |
| 10% | 383 |
| 50% | 458 |
| 90% | 565 |
| F.B.P. | 632 |
| Recovery | 99 |

22. A composition according to claim 1, wherein component (3) is a diesel oil having the following characteristics:

| | | |
|---|---|---|
| A.P.I. Gravity | | 32–36 |
| Colour | | 0.5 |
| Sulphur, % | | 0.5 |
| Cloud Point, °F. | | +20 |
| Pour Point, °F. | | +10 |
| Flash Point, °F. | | 125 Minimum |
| Cetane Index | | 40+ |
| Viscosity: Kinematic at 100° F. (centistokes) | | 3.1 |
| SUS at 100° F. | | 36 |
| Distillation: | | |
| I.B.P. °F. | | 362 |
| 10% | | 420 |
| 50% | | 528 |
| 90% | | 618 |
| F.B.P. °F. | | 654 |
| Chemical Analysis: | | |
| Calcium | 0.030 ppm | |
| Nickel | 0.08 ppm | |
| Sodium | 0.57 ppm | |
| Lead | 0.013 ppm | |
| Potassium | 0.10 ppm | |
| Vanadium | 0.28 ppm | |

23. A composition according to claim 1, in which component (2) is a blend of HVI 100 Neutral Oil with HVI 250 Neutral Oil: and HVI 100 Neutral Oil having the following characteristics:

| | |
|---|---|
| Density at 15° C., kg/L | 0.8571 |
| Colour, ASTM D 1300 | L 0.5 |
| Pour Point, °C. | −18 |
| Flash, COC, °C. | 196 min. |
| Viscosity at 40° C., $mm^2/s$ | 19.12 |
| Viscosity at 100° C., $mm^2/s$ | 3.92 |
| Viscosity Index | 95 |
| Carbon Residue, % by mass | 0.07 |
| Neutralization Value, mg KOH/g. TAN-C | 0.01 |
| Sulphur, % by mass | 0.36 |
| Corrosion at 100° C., Cu. strip 3 h | No. 1 |
| Active Sulphur at 204° C. | Nil |
| Appearance | Clean and Bright |
| Aniline Point, °C. | 99.5 |
| and said HVI 250 Neutral Oil having the following characteristics: | |
| Density at 15° C., kg/L | 0.8741 |
| Colour, ASTM D 1300 | L 0.5 |
| Pour Point, °C. | −15 |
| Flash, COC, °C. | 226 min. |
| Viscosity at 40° C., $mm^2/s$ | 51.2 |
| Viscosity at 100° C., $mm^2/S$ | 7.08 |

-continued

| | |
|---|---|
| Viscosity Index | 94 |
| Carbon Residue, % by mass | 0.07 |
| Neutralization Value, mg KOH/g. TAN-C | 0.01 |
| Sulphur, % by mass | 0.54 |
| Corrosion at 100° C. Cu. strip 3 h | No. 1 |
| Active Sulphur at 204° C. | Nil |
| Appearance | Clear and Bright |
| Aniline Point, °C. | 105 |

24. A composition according to claim 1, wherein component (1) additionally contains from about 0.1% to about 3% by weight of a non-aromatic odorant material.

25. A composition according to claim 1, wherein component (2) is an oil having a viscosity in the range of from about 45 SUS at 100° F. to about 1200 SUS at 100° F.

26. A composition according to claim 1, wherein component (2) is a hydraulic oil having a viscosity ranging from about 45 SUS at 100° F. to about 720 SUS at 100° F.

27. A lubricant additive composition comprising:

(1) about 35% by weight of a 24% (by weight) and solution of lead naphthenate in an organic solvent therefor;

(2) about 40% by weight of an oil having the following formulation:

97.4%–93.1% HVI 300 Neutral Paraffinic Base Oil
0.05%–0.15% anti-oxidant
0.0005%–0.005% anti-foaming agent
0.5%–1.5% anti-rust compound
1.0%–2.0% oiliness additive
1.0%–3.0% anti-wear compound
0.005%–0.25% pour point depressant; and (3) about 25% by weight of diesel oil;

said composition having both friction-reducing properties and extreme-pressure properties.

28. The lubricant additive composition of claim 27 wherein component (3) is a desulfurized diesel oil.

29. The lubricant additive composition of claim 27 wherein component (1) additionally contains about 1% by weight of an non-aromatic odorant material.

30. A lubricant additive composition according to claim 27 which further comprises from 0.01% to 1.00% by weight of an antioxidant.

31. A composition according to claim 28 wherein the desulfurized diesel oil has the following characteristics:

| | |
|---|---|
| A.P.I. Gravity | 40.4 |
| Specific Gravity | 0.823 |
| Colour | 10.5 |
| Sulphur, % | 0.5 |
| Cloud Point °F. | −35 |
| Pour Point, °F. | −40 |
| Flash Point, °F. | 150 |
| Cetane Number | 48 |
| Viscosity: Kinematic at 100° F. (centistokes) | 1.9 |
| SUS at 100° F. | 32.0 |
| Distillation °F.: | |
| I.B.P. | 349 |
| 10% | 385 |
| 50% | 440 |
| 90% | 514 |
| F.B.P. | 560 |
| Recovery | 99 |

32. A composition according to claim 28 wherein the desulfurized diesel oil has the following characteristics:

| | |
|---|---|
| A.P.I. Gravity | 39.4 |
| Colour | 0.5 |
| Sulphur, % | 0.5 |
| Cloud Point, °F. | −10 |
| Pour Point, °F. | −25 |
| Flash Point, °F. | 145 |
| Cetane Index | 46 |
| Viscosity - Kinematic at 100° F. (centistokes) | 2.0 |
| SUS at 100° F. | 33 |
| Distillation °F.: | |
| I.B.P. | 344 |
| 10% | 383 |
| 50% | 458 |
| 90% | 565 |
| F.B.P. | 632 |
| Recovery | 99 |

33. A composition according to claim 28 wherein the desulfurized diesel oil has the following characteristics:

| | | |
|---|---|---|
| A.P.I. Gravity | | 32–36 |
| Colour | | 0.5 |
| Sulphur, % | | 0.5 |
| Cloud Point, °F. | | +20 |
| Pour Point, °F. | | +10 |
| Flash Point, °F. | | 125 Minimum |
| Cetane Index | | 40+ |
| Viscosity: Kinematic at 100° F. (centistokes) | | 3.1 |
| SUS at 100° F. | | 36 |
| Distillation: | | |
| I.B.P. °F. | | 362 |
| 10% | | 420 |
| 50% | | 528 |
| 90% | | 618 |
| F.B.P. °F. | | 654 |
| Chemical Analysis: | | |
| Calcium | 0.030 ppm | |
| Nickel | 0.08 ppm | |
| Sodium | 0.57 ppm | |
| Lead | 0.013 ppm | |
| Potassium | 0.10 ppm | |
| Vanadium | 0.28 ppm | |

34. A lubricant additive composition according to claim 1 wherein component (2) is an oil having the following formulation:

97.4%–93.1% HVI 300 Neutral Paraffinic Base Oil
0.05%–0.15% anti-oxidant
0.0005%–0.005% anti-foaming agent
0.5%–1.5% anti-rust compound
1.0%–2.0% oiliness additive
1.0%–3.0% anti-wear compound
0.005%–0.25% pour point depressant

35. A lubricant additive composition according to claim 2 wherein component (2) is an oil having the following formulation:

97.4%–93.1% HVI 300 Neutral Paraffinic Base Oil
0.05%–0.15% anti-oxidant
0.0005%–0.005% anti-foaming agent
0.5%–1.5% anti-rust compound
1.0%–2.0% oiliness additive
1.0%–3.0% anti-wear compound
0.005%–0.25% pour point depressant

36. A lubricant additive composition according to claim 13 wherein component (2) is an oil having the following formulation:

97.4%–93.1% HVI 300 Neutral Paraffinic Base Oil 0.05%–0.15% anti-oxidant
0.0005%–0.005% anti-foaming agent
0.5%–1.5% anti-rust compound
1.0%–2.0% oiliness additive
1.0%–3.0% anti-wear compound
0.005%–0.25% pour point depressant

37. A lubricant additive composition according to claim 14 wherein component (2) is an oil having the following formulation:

97.4%–93.1% HVI 300 Neutral Paraffinic Base Oil
0.05%–0.15% anti-oxidant
0.0005%–0.005% anti-foaming agent
0.5%–1.5% anti-rust compound
1.0%–2.0% oiliness additive
1.0%–3.0% anti-wear compound
0.005%–0.25% pour point depressant

38. A lubricant composition comprising a major proportion of a lubricating oil, and from about 1.0 volume percent to about 7.5 volume percent, based on the volume of said lubricant, of the additive composition defined in claim 1.

39. A lubricant composition comprising a major proportion of a lubricating oil, and from about 1.0 volume percent to about 7.5 volume percent, based on the volume of said lubricant, of the additive composition defined in claim 27.

40. A lubricant composition comprising a major proportion of a lubricating oil, and from about 1.0 volume percent to about 7.5 volume percent, based on the volume of said lubricant, of the additive composition defined in claim 34.

41. A lubricant composition comprising a major proportion of a lubricating oil, and from about 1.0 volume percent to about 7.5 volume percent, based on the volume of said lubricant, of the additive composition of claim 35.

42. A lubricant composition according to claim 38, wherein the additive is present in said lubricant composition in an amount of from about 2.5 volume percent to about 7.5 volume percent, based on the volume of said lubricant.

43. A lubricant composition according to claim 38, wherein the additive is present is said lubricant composition in an amount of about 2.5 volume percent based on the volume of said lubricant.

* * * * *

UNITED STATES PATENT AND TRADEMARK OFFICE

CERTIFICATE OF CORRECTION

PATENT NO. : 4,555,352

DATED : November 26, 1985

INVENTOR(S) : Alfred V. Garner; William W. Nalder

It is certified that error appears in the above-identified patent and that said Letters Patent is hereby corrected as shown below:

[73] Assignee: Power-Aid Industries (1980) Ltd., Raymond, Alberta, Canada

Page 1, Column 1, under heading "OTHER PUBLICATIONS", line 1, change "Smacheer" to --Smalheer--

Column 3, line 30, change "or" (first occurrence) to --of--;
line 51, change "vicosity" to --viscosity--;
line 68, change "anit-wear" to --anti-wear--;

Column 4, line 51, change "on" to --in--;
line 52, change "napthenate" to -- naphthenate --.

Column 6, line 67, change "buy" to -- by --.
Column 8, line 2, change "four" to -- our --.
Column 13, line 5, change "ethylhexaneoate" to -- ethylhexanoate --.

Signed and Sealed this

Fifteenth Day of March, 1988

*Attest:*

DONALD J. QUIGG

*Attesting Officer*

*Commissioner of Patents and Trademarks*